US005095338A

United States Patent [19]

Hayes, Jr. et al.

[11] Patent Number: 5,095,338

[45] Date of Patent: Mar. 10, 1992

[54] DEVELOPER WHICH DISCHARGES USED CARRIER PARTICLES USING A MAGNETIC VALVE

[75] Inventors: Thomas A. Hayes, Jr., Santa Ana, Calif.; Clem J. Nagley, Rochester; Anthony L. Paolini, W. Henrietta, both of N.Y.

[73] Assignee: Xerox Corporation, Stamford, Conn.

[21] Appl. No.: 658,728

[22] Filed: Feb. 21, 1991

[51] Int. Cl.[5] ..... G03G 21/00

[52] U.S. Cl. ..... 355/246; 118/657; 355/251

[58] Field of Search ..... 355/200, 215, 251, 245, 355/246, 208; 118/656, 657, 658, 689, 690, 691, 694, 652; 430/108, 109, 120, 122

[56] References Cited

U.S. PATENT DOCUMENTS

| | | | |
|---|---|---|---|
| 4,614,165 | 9/1986 | Folkins et al. | 118/657 |
| 4,891,671 | 1/1990 | Iwamasa | 118/657 X |
| 4,891,673 | 1/1990 | Buell | 355/245 |
| 4,932,355 | 6/1990 | Neufeld | 355/246 X |

*Primary Examiner*—A. T. Grimley

*Assistant Examiner*—Christopher Horgan

*Attorney, Agent, or Firm*—H. Fleischer; J. E. Beck; R. Zibelli

[57] ABSTRACT

A developer unit which develops an electrostatic latent image recorded on a photoconductive member used in an electrophotographic printing machine. The developer unit uses a developer material which ages during the life of the electrophotographic printing machine. Additional developer material having at least carrier granules and toner particles, is supplied to the developer material in the developer unit to extend the life of the developer material. Discharge of developer material from the developer unit is controlled by a permanent magnet and an electromagnet positioned adjacent an exit port in the developer unit. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted thereto is discharged therefrom.

19 Claims, 2 Drawing Sheets

DEVELOPER WHICH DISCHARGES USED CARRIER PARTICLES USING A MAGNETIC VALVE

Figure 1:
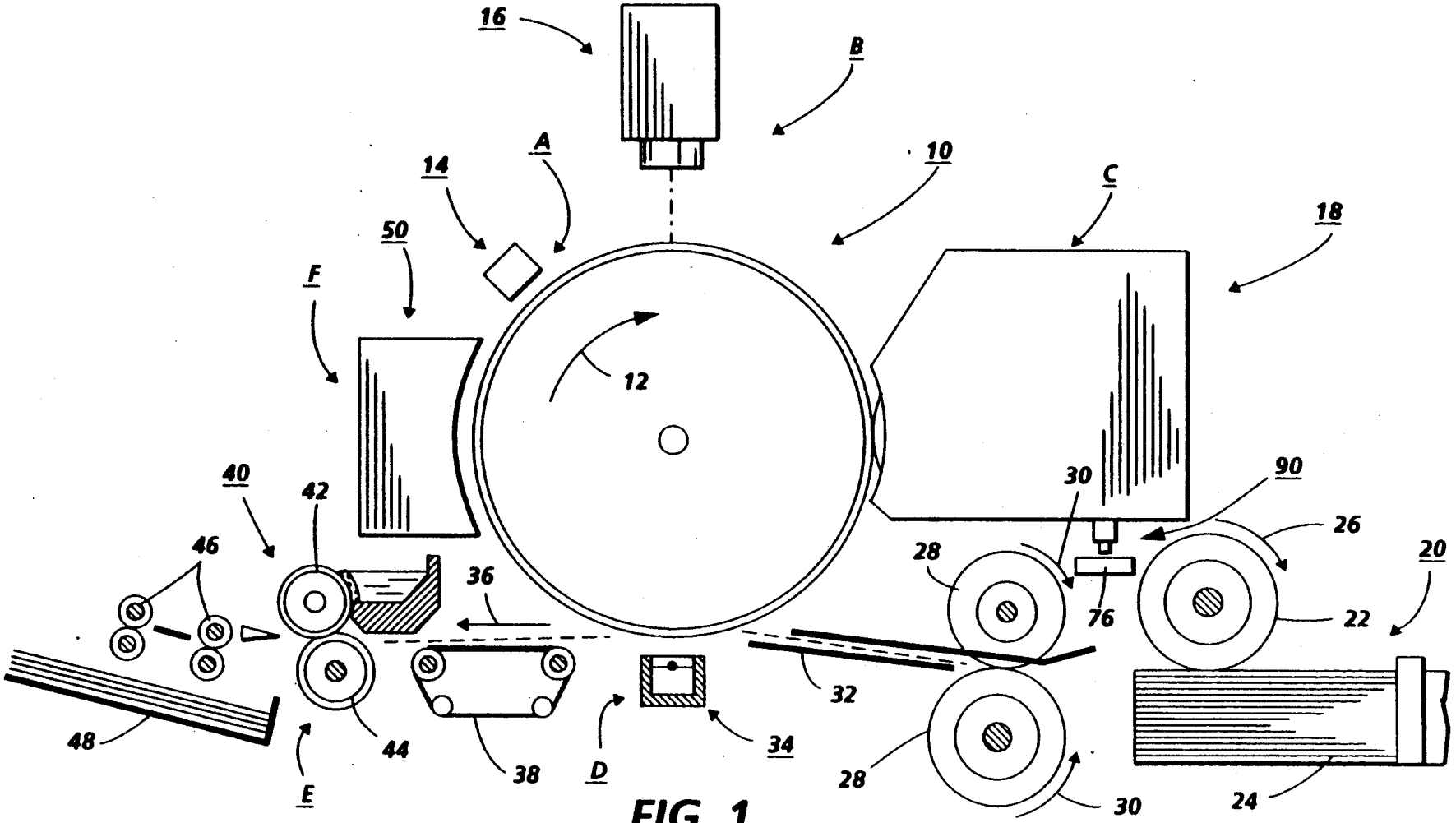

This invention relates generally to an electrophotographic printing machine, and more particularly concerns an apparatus for developing an electrostatic latent image recorded on a photoconductive member used in the electrophotographic printing machine.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. This forms a powder image on the photoconductive member which is subsequently transferred to a copy sheet and permanently affixed thereto in image configuration.

Typically, the developer material comprises toner particles adhering triboelectrically to magnetic carrier granules. This two component mixture is brought into contact with the photoconductive surface. The toner particles are attracted from the carrier granules to the latent image. It is clear that the developer material is a critical component of the printing machine. As the developer material ages and approaches the end of its useful life, copy quality deteriorates. It has been found that by adding additional carrier granules, the life of the developer material can be significantly increased. However, as additional carrier granules are added to the chamber storing the developer material, developer material must be removed therefrom to maintain the developer material therein at the desired quantity. In a developer unit wherein carrier granules and toner particles are added to the chamber of the developer housing, provision must be made for regulating the discharge of developer material therefrom to maintain the desired quantity of developer material. Thus, it is necessary to use a control valve to regulate the discharge of developer material from the chamber of the developer housing. Preferably, the control valve used for this purpose has no moving parts. Various techniques have hereinbefore been used to achieve the foregoing as illustrated by the following disclosures, which may be relevant to certain aspects of the present invention:

U.S. Pat. No. 4,614,165
Patentee: Folkins et al.
Issued: Sept. 30, 1986

U.S. Pat. No. 4,891,673
Patentee: Buell
Issued: Jan. 2, 1990

The pertinent portions of the foregoing patents may be briefly summarized as follows:

U.S. Pat. No. 4,614,165 discloses a development apparatus wherein additional carrier granules are continually added to developer material in the chamber of the developer housing. An exit port is provided to remove the excess developer material so as to maintain the developer material at a predetermined quantity.

U.S. Pat. No. 4,891,673 describes a developer unit in which carrier granules are added to the developer material in conjunction with toner particles. When the level of developer material in the developer material housing is at the exit port, developer material is discharged from the chamber. A permanent magnet is positioned around the exit port to generate a magnetic flux field to form a carrier bead curtain which prevents the passage of toner particles while permitting developer material and carrier granules to exit.

In accordance with one aspect of the present invention, there is provided an apparatus for controlling developer material discharge from an exit port of a developer unit of the type having carrier granules and toner particles dispensed therein. The apparatus includes first means for generating a first magnetic flux field in the region of the exit port of the developer unit to form a developer material curtain which prevents the passage of developer material therethrough. Second means are provided for generating, upon energization, a second magnetic flux field in the region of the exit port of the developer unit. The second magnetic flux field attracts developer material from the developer material curtain with the developer material attracted to the second means being discharged upon de-energization of the second means.

Pursuant to another aspect of the present invention, there is provided an apparatus for developing an electrostatic latent image. The apparatus includes means for transporting a developer material comprising at least carrier granules having toner particles adhering thereto adjacent the electrostatic latent image. A housing defines a chamber having a supply of developer material therein. The transporting means is in communication with the chamber of the housing for receiving developer material. The housing has an exit port for removing developer material from the chamber. Means are provided for discharging toner particles and carrier granules into the chamber of the housing. Means detect the quantity of developer material in the chamber of the housing. Means are provided for sealing the exit port of the housing. The sealing means, responsive to the detecting means indicating that the quantity of the developer material is greater than a predetermined quantity, permits developer material to be discharged from the exit port reducing the quantity of developer material in the chamber of the housing.

In still another aspect of the present invention, there is provided an electrophotographic printing machine of the type having an electrostatic latent image recorded on a photoconductive member. The improvement includes means for transporting a developer material comprising at least carrier granules having toner particles adhering thereto closely adjacent to the electrostatic latent image recorded on the photoconductive member. A housing defines a chamber having a supply of developer material therein. The transporting means is in communication with the chamber of the housing for receiving developer material. The housing has an exit port for removing developer material from the chamber. Means are provided for discharging toner particles and carrier granules into the chamber of the housing. Means detect the quantity of the developer material in the chamber of the housing. Means are provided for sealing the exit port of the housing. The sealing means, responsive to the detecting means indicating that the quantity of the developer material is greater than a predetermined quantity, permits developer material to be discharged reducing the quantity of developer material in the chamber of the housing.

Figure 2:
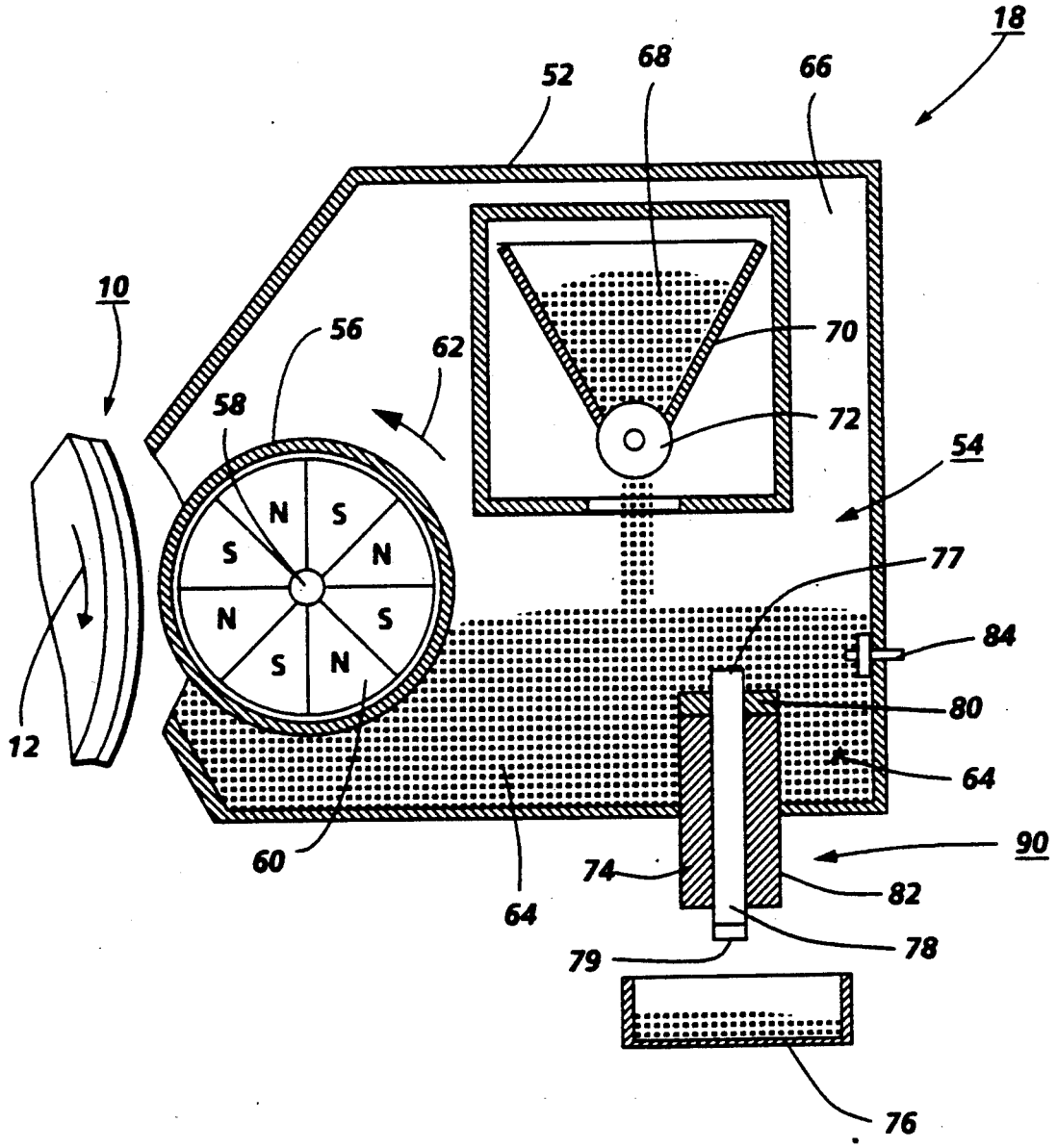

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is a fragmentary, elevational view of the developer unit used in the FIG. 1 printing machine.

While the present invention will be described hereinafter in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine having the developer unit of the present invention therein. It will become evident from the following discussion that this developer unit is equally well suited for use in a wide variety of printing machines and is not necessarily limited in its application to the particular printing machine described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface adhering to a conductive substrate. Preferably, the photoconductive surface comprises a selenium alloy with the conductive substrate being an electrically grounded aluminum alloy. Drum 10 moves in the direction of arrow 12 to advance successive portions of the photoconductive surface sequentially through the various processing stations disposed about the path of movement thereof.

Initially, a portion of the photoconductive surface passes through charging station A. At charging station A, a corona generating device, indicated generally by the reference numeral 14, charges the photoconductive surface to a relatively high, substantially uniform potential.

Next, the charged portion of the photoconductive surface is advanced through imaging station B. Imaging station B includes an exposure system, indicated generally by the reference numeral 16. Exposure system 16 includes lamps which illuminate an original document positioned face down upon a transparent platen. The light rays reflected from the original document are transmitted through a lens to form a light image thereof. The light image is focused onto the charged portion of the photoconductive surface to selectively dissipate the charge thereon. This records an electrostatic latent image on the photoconductive surface which corresponds to the information in the original document. One skilled in the art will appreciate that in lieu of the foregoing optical system, a modulated beam of energy, i.e. a laser beam, or other suitable device, such as light emitting diodes, may be used to irradiate the charged portion of the photoconductive surface so as to record selected information thereon. Information from a computer may be employed to modulate the laser beam.

After the electrostatic latent image is recorded on the photoconductive surface, drum 10 advances the electrostatic latent image to development station C. At development station C, a magnetic brush developer unit, indicated generally by the reference numeral 18, transports a developer material of magnetic carrier granules having toner particles adhering triboelectrically thereto closely adjacent to, or into contact with the electrostatic latent image. Toner particles are attracted from the carrier granules to the latent image forming a toner powder image. In the development system, toner particles and a small amount of carrier granules are continually added to the developer material so that the life of the developer material is at least equal to the useful life of the electrophotographic printing machine. Excess developer material exits the developer unit through an exit port. A seal, indicated generally by the reference numeral 90, controls the discharge of developer material from the developer unit into a waste container system 76. By way of example, waste container system 76 has a container, augers and the necessary motors to dispose of the discharged developer material. Further details of seal 90 and developer unit 18 will be described hereinafter with reference to FIG. 2.

Drum 10 then advances the toner powder image to transfer station D. At transfer station D, a sheet of support material is moved into contact with the toner powder image. The sheet of support material is advanced to transfer station D by a sheet feeding apparatus, indicated generally by the reference numeral 20. Preferably, sheet feeding apparatus 20 includes a feed roll 22 contacting the uppermost sheet of a stack of sheets 24. Feed roll 22 rotates in the direction of arrow 26 to advance the uppermost sheet into a nip defined by forwarding rollers 28. Forwarding rollers 28 rotate in the direction of arrow 30 to advance the sheet into chute 32. Chute 32 directs the advancing sheet into contact with the photoconductive surface in a timed sequence so that the toner powder image developed thereon contacts the advancing sheet at transfer station D.

Transfer station D includes a corona generating device 34 which sprays ions onto the backside of the sheet. This attracts the toner powder image from the photoconductive surface to the sheet. After transfer, the sheet continues to move in the direction of arrow 36 on conveyor 38 to advance to fusing station E.

Fusing station E includes a fuser assembly, indicated generally by the reference numeral 40, which permanently affixes the transferred toner powder image to the sheet. Preferably, fuser assembly 40 includes a heated fuser roller 42 and a back-up roller 44. The sheet passes between fuser roller 42 and back-up roller 44 with the powder image contacting fuser roller 42. In this manner, the toner powder image is permanently affixed to the sheet. After fusing, forwarding rollers 46 advance the sheet to catch tray 48 for subsequent removal from the printing machine by the operator.

After the powder image is transferred from the photoconductive surface to the copy sheet, drum 10 rotates the photoconductive surface to cleaning station F. At cleaning station F, a cleaning system, indicated generally by the reference numeral 50, removes the residual particles adhering to the photoconductive surface. In this way, the residual toner particles are removed from the photoconductive surface.

It is believed that the foregoing description is sufficient for purposes of the present invention to illustrate the general operation of an electrophotographic printing machine incorporating the features of the present invention therein.

Referring now to the specific subject matter of the present invention, FIG. 2 illustrates developer unit 18 in greater detail. Developer unit 18 includes a developer housing 52 defining a chamber 54 storing a supply of developer material including carrier granules and toner particles therein. A tubular member or sleeve 56 is mounted rotatably on shaft 58 in chamber 54 of housing 52. An elongated cylindrical magnet 60 is mounted interiorly of sleeve 56. Magnet 60 is mounted stationarily and has a plurality of magnetic poles impressed upon the circumferential surface thereof to generate a magnet field. A motor (not shown) rotates sleeve 56 in the direction of arrow 62. As sleeve 56 rotates in chamber 54 of housing 52, the developer material is attracted thereto. The rotation of sleeve 56 transports the developer material attracted thereto closely adjacent to or into contact with the photoconductive surface. In the development zone, the toner particles are attracted from the carrier granules to the latent image recorded on the photoconductive surface of drum 10. A voltage source electrically biases sleeve 56 to a suitable polarity and magnitude so that the toner particles are deposited on the latent image. Preferably, sleeve 56 is made from aluminum with magnet 60 being made from barium ferrite.

A supply of developer material 64 is stored in chamber 54 of housing 52. Sleeve 56 is mounted in chamber 54 of housing 52 with a portion thereof extending outwardly through an opening in housing 52 so that the developer material is readily advanced, during the rotation of sleeve 56 in the direction of arrow 62, to the latent image recorded on the photoconductive surface of drum 10. As the electrophotographic printing machine is used, toner particles are depleted therefrom and must be replenished. In addition, the carrier granules age and the entire developer material package, i.e. carrier granules and toner particles, must be periodically replaced in order to maintain the requisite copy quality. In order to solve this problem and be capable of employing a developer material having a useful life at least equal to the usable life of the electrophotographic printing machine, carrier granules are trickled into the developer material. A discharging unit, indicated generally by the reference numeral 68, dispenses a small quantity of carrier granules and the requisite amount of toner particles to developer material 64. Discharging unit 68 is shown as being located in chamber 54 of housing 52. However, one skilled in the art will appreciate that it may be located remotely therefrom as well. Discharging unit 68 includes an open ended hopper 70 having a foam roller 72 positioned in the open end thereof. A mixture 68 of carrier granules and toner particles is stored in hopper 70. As roller 72 rotates, carrier granules and toner particles are discharged from hopper 70 to developer material 64 in chamber 54 of housing 52. The ratio of toner particles to carrier granules by weight being discharged from hopper 70 is substantially greater than the ratio of toner particles to carrier granules by weight in developer material 64. By way of example, the developer material being dispensed from discharging unit 68 may be 25% carrier granules by weight and 75% toner particles by weight with developer material 64 in chamber 66 of housing 52 being about 96% carrier granules by weight and 4% toner particles by weight. A development system of the foregoing type is more fully described in U.S. Pat. No. 4,614,165 issued to Folkins et al. on Sept. 30, 1986, the relevant portions thereof being hereby incorporated into the present application.

An exit port 74 is located in the bottom wall of housing 52. A conduit or tube 78 is positioned in exit port 74. A portion of tube 78 extends outwardly from housing 52 with another portion of tube 78 extending inwardly into chamber 54. Developer material above the level of entrance 77 of tube 78 is discharged into tube 78. A permanent magnet 80 is positioned around tube 80 in the region of entrance 77. Magnet 78 generates a magnetic flux field in the region of entrance 77. The developer material includes at least magnetic carrier granules having toner particles adhering triboelectrically thereto. The magnetic flux field attracts the magnetic carrier granules forming a developer material curtain across the opening of entrance 77 to tube 78. The developer material curtain prevents the passage of developer material into tube 78 sealing entrance 77 of tube 78 preventing the discharge of developer material from chamber 54 of housing 52. An electromagnet 82 is also positioned about tube 78 adjacent permanent magnet 80. When electromagnet 82 is de-energized, the entrance 77 to tube 78 is sealed preventing developer material from being discharged from chamber 54. However, when electromagnet 82 is energized, it generates a magnetic flux field which attracts developer material from the developer material curtain. Upon the subsequent de-energization of electromagnet 82, the developer material attracted thereto is discharged from exit 79 of tube 78 into waste container system 76. The developer material curtain reforms with the de-energization of electromagnet 82 re-sealing entrance 77 to tube 78.

With continued reference to FIG. 2, sensing system 84 detects the quantity of developer material in chamber 54. Sensing system 84 is connected to the printing machine controller. When sensing system 84 detects that the quantity of developer material in chamber 54 of housing 52 exceeds a predetermined quantity, it transmits a signal to the printing machine controller indicative thereof. In the controller, the sensor signal is processed by a suitable algorithm to generate a signal that actuates electromagnet 82. In actuality, sensing system 84 detects the level of developer material in chamber 54 of housing 52. When the level of developer material exceeds a predetermined level, sensing system 84 transmits a signal indicating this to the controller. This corresponds to detection of the quantity of developer material inasmuch as the quantity developer material is directly proportional to the level of developer material in chamber 52 of housing 54. By way of example, sensing system 84 may use an optical sensor having a light emitting diode and a photodiode. The photodiode emits a signal responsive to the light received from the light emitting diode. When the level of the developer material is such that the beam of light from the light emitting diode to the photodiode is broken, the photodiode transmits a signal to the printing machine controller that the level of the developer material has exceeded the predetermined level. The controller then transmits a signal which energizes electromagnet 82. Upon being energized, electromagnet 82 generates a magnetic flux field which attracts developer material from the developer material curtain. Additional developer material from the chamber then enters the tube to reform the developer material curtain and the foregoing continues until the level of developer material is beneath the preselected level. At that time, the developer material level is beneath the light beam from the light emitting diode and the photodiode transmits a signal indicative thereof to the controller. The controller then transmits a signal to de-energize electromagnet 82. The developer material in tube 78 attracted from the developer material curtain by the magnetic flux field generated by electromagnet 82 is now discharged from exit 79 of tube 78 into waste container 76. By way of example, magnet 80 is preferably a ring of magnets surrounding tube 78 in the vicinity of the entrance thereto.

In recapitulation, the developer unit of the present invention has toner particles and carrier granules added to the developer material therein. Extraneous developer material exits from the developer unit through a tube which has a developer material curtain sealing the entrance thereto. The developer material curtain is formed by a permanent magnet generating a magnetic flux field adjacent the entrance to the tube. An electromagnet, adjacent the permanent magnet, is energized when the level of the developer material exceeds a predetermined level. The electromagnet generates another magnetic flux field which attract developer material from the developer material curtain. Upon de-energization of the electromagnet, the developer material attracted by the magnetic flux field is discharged from the tube exit into a waste container.

It is, therefore, apparent that there has been provided, in accordance with the present invention, a developer unit that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and scope of the appended claims.

We claim:

1. An apparatus for controlling developer material discharge from an exit port of a developer unit of the type having carrier granules and toner particles dispensed therein, including:

first means for generating a first magnetic flux field in the region of the exit port of the developer unit to form a developer material curtain which prevents the passage of developer material therethrough; and second means for generating, upon energization, a second magnetic flux field in the region of the exit port of the developer unit to attract developer material from the developer material curtain with the developer material attracted thereto being discharged therefrom upon de-energization of said second means.

2. An apparatus according to claim 1, further including a conduit in association with the exit port of the developer unit for discharging developer material therefrom.

3. An apparatus according to claim 2, wherein said first generating means includes a magnetic member disposed about said conduit.

4. An apparatus for controlling developer material discharge from an exit port of a developer unit of the type having carrier granules and toner particles dispensed therein, including:

a conduit in association with the exit port of the developer unit for discharging developer material therefrom;

first means for generating a first magnetic flux field in the region of the exit port of the developer unit to form a developer material curtain which prevents the passage of developer material therethrough, said first generating means includes a magnetic member disposed about said conduit; and second means for generating, upon energization, a second magnetic flux field in the region of the exit port of the developer unit to attract developer material from the developer material curtain with the developer material attracted thereto being discharged therefrom upon de-energization of said second means, said second generating means includes an electromagnet disposed about said conduit adjacent said first magnetic member.

5. An apparatus according to claim 4, further including means for detecting the level of the developer material in the developer unit, said detecting means regulating energization and de-energization of said electromagnet.

6. An apparatus for developing a latent image, including:

means for transporting a developer material comprising at least carrier granules having toner particles adhering thereto adjacent the latent image;

a housing defining a chamber having a supply of developer material therein, said transporting means being in communication with the chamber of said housing for receiving developer material, said housing having an exit port for removing developer material from the chamber thereof;

means for discharging toner particles and carrier granules into the chamber of said housing;

means for detecting the quantity of developer material in the chamber of said housing; and means for sealing the exit port of said housing, said sealing means, responsive to said detecting means indicating that the quantity of the developer material is greater than a predetermined quantity, permits developer material to be discharged from the exit port reducing the quantity of developer material in the chamber of said housing, said sealing means comprises first means for generating a first magnetic flux field in the region of the exit port of said housing to form a developer material curtain which prevents the passage of developer material therethrough, and second means for generating, upon energization, a second magnetic flux field in the region of the exit port of said housing to attract developer material from the developer material curtain with the developer material attracted thereto being discharged therefrom upon de-energization of said second means.

7. An apparatus according to claim 6, further including a conduit in association with the exit port of said housing for discharging developer material therefrom.

8. An apparatus according to claim 7, wherein said first generating means includes a magnetic member disposed about said conduit.

9. An apparatus for developing a latent image, including:

means for transporting a developer material comprising at least carrier granules having toner particles adhering thereto adjacent the latent image;

a housing defining a chamber having a supply of developer material therein, said transporting means being in communication with the chamber of said housing for receiving developer material, said housing having an exit port for removing developer material from the chamber thereof;

a conduit in association with the exit port of said housing for discharging developer material therefrom;

means for discharging toner particles and carrier granules into the chamber of said housing;

means for detecting the quantity of developer material in the chamber of said housing; and means for sealing the exit port of said housing, said sealing means, responsive to said detecting means indicating that the quantity of the developer material is greater than a predetermined quantity, permits developer material to be discharged from the exit port reducing the quantity of developer material in the chamber of said housing, said sealing means comprises first means for generating a first magnetic flux field in the region of the exit port of said housing to form a developer material curtain which prevents the passage of developer material therethrough, and second means for generating, upon energization, a second magnetic flux field in the region of the exit port of said housing to attract developer material from the developer material curtain with the developer material attracted thereto being discharged therefrom upon de-energization of said second means, said first generating means includes a magnetic member disposed about said conduit, said second generating means includes an electromagnet disposed about said conduit adjacent said first magnetic member, said detecting means being adapted to regulate energization and de-energization of said electromagnet.

10. An apparatus according to claim 9, wherein the ratio of toner particles to carrier granules by weight being added by said discharging means to the chamber of the housing is substantially greater than the ratio of toner particles to carrier granules by weight in the chamber of said housing.

11. An apparatus according to claim 9, wherein said discharging means includes means for storing a supply of carrier granules and toner particles.

12. An apparatus according to claim 9, wherein said detecting means detects the level of the developer material in the chamber of said developer housing.

13. An electrophotographic printing machine of the type having an electrostatic latent image recorded on a photoconductive member, wherein the improvement includes:

means for transporting a developer material comprising at least carrier granules having toner particles adhering thereto closely adjacent to the electrostatic latent image recorded on the photoconductive member;

a housing defining a chamber having a supply of developer material therein, said transporting means being in communication with the chamber of said housing for receiving developer material, said housing having an exit port for removing developer material from the chamber thereof;

means for discharging toner particles and carrier granules into the chamber of said housing;

means for detecting the quantity of the developer material in the chamber of said housing; and means for sealing the exit port of said housing, said sealing means, responsive to said detecting means indicating that the quantity of the developer material is greater than a predetermined quantity, permits developer material to be discharged reducing the quantity of developer material in the chamber of said housing, said sealing means comprises first means for generating a first magnetic flux field in the region of the exit port of said housing to form a developer material curtain which prevents the passage of developer material therethrough, and second means for generating, upon energization, a second magnetic flux field in the region of the exit port of said housing to attract developer material from the developer material curtain with the developer material attracted thereto being discharged therefrom upon de-energization of said second means.

14. A printing machine according to claim 13, further including a conduit in association with the exit port of the developer unit for discharging developer material therefrom.

15. A printing machine according to claim 14, wherein said first generating means includes a magnetic member disposed about said conduit.

16. An electrophotographic printing machine of the type having an electrostatic latent image recorded on a photoconductive member, wherein the improvement includes:

means for transporting a developer material comprising at least carrier granules having toner particles adhering thereto closely adjacent to the electrostatic latent image recorded on the photoconductive member;

a housing defining a chamber having a supply of developer material therein, said transporting means being in communication with the chamber of said housing for receiving developer material, said housing having an exit port for removing developer material from the chamber thereof;

a conduit in association with the exit port of said housing for discharging developer material therefrom;

means for discharging toner particles and carrier granules into the chamber of said housing;

means for detecting the quantity of the developer material in the chamber of said housing; and means for sealing the exit port of said housing, said sealing means, responsive to said detecting means indicating that the quantity of the developer material is greater than a predetermined quantity, permits developer material to be discharged reducing the quantity of developer material in the chamber of said housing, said sealing means i comprises first means for generating a first magnetic flux field in the region of the exit port of said housing to form a developer material curtain which prevents the passage of developer material therethrough, and second means for generating, upon energization, a second magnetic flux field in the region of the exit port of said housing to attract developer material from the developer material curtain with the developer material attracted thereto being discharged therefrom upon de-energization of said second means, said first generating means comprises a magnetic member disposed about said conduit, said second generating means includes an electromagnet disposed about said conduit adjacent said first magnetic member, said detecting means being adapted to regulate energization and de-energization of said electromagnet.

17. A printing machine according to claim 16, wherein said discharging means includes means for storing a supply of carrier granules and toner particles.

18. A printing machine according to claim 16, wherein the ratio of toner particles to carrier granules by weight being added by said discharging means to the chamber of the housing is substantially greater than the ratio of toner particles to carrier granules by weight in the chamber of said housing.

19. A printing machine according to claim 16, wherein said detecting means detects the level of developer material in the chamber of said housing.

* * * * *